US005378197A

United States Patent [19]

Briggs

[11] Patent Number: 5,378,197

[45] **Date of Patent: * Jan. 3, 1995**

[54] WATERSLIDE PLAY APPARATUS

[76] Inventor: Rick A. Briggs, Sixty-four Maple Grove Rd., Springfield, Ill. 62707

[ * ] Notice: The portion of the term of this patent subsequent to Mar. 16, 2010 has been disclaimed.

[21] Appl. No.: 54,559

[22] Filed: Apr. 28, 1993

Related U.S. Application Data

[63] Continuation-in-part of Ser. No. 25,143, Mar. 2, 1993, which is a continuation of Ser. No. 4,496, Oct. 29, 1990, Pat. No. 5,194,048, which is a continuation-in-part of Ser. No. 438,220, Nov. 20, 1989, Pat. No. Des. 330,579.

[51] Int. Cl.[6] ..... A63G 21/00

[52] U.S. Cl. ..... 472/128; 482/35

[58] Field of Search ..... 482/35-37; 472/117, 128

[56] References Cited

U.S. PATENT DOCUMENTS

| | | | |
|---|---|---|---|
| 1,648,196 | 11/1927 | Rohmer | 104/70 |
| 3,539,181 | 11/1979 | Larsen . | |
| 4,057,244 | 11/1977 | Gaspar | 472/128 |
| 4,145,042 | 3/1979 | Becker | 472/117 |
| 4,149,710 | 4/1979 | Rouchard | 472/117 |
| 4,194,733 | 3/1980 | Whitehouse | 472/117 |
| 4,196,900 | 4/1980 | Becker | 472/117 |
| 4,343,464 | 8/1982 | Dose | 472/117 |
| 4,573,679 | 3/1986 | Janszen | 472/128 |
| 4,799,665 | 1/1989 | Bracy | 472/128 |
| 4,805,897 | 2/1989 | Dubeta . | |
| 4,805,898 | 2/1989 | Jacober . | |
| 5,011,134 | 4/1991 | Langford . | |
| 5,194,048 | 3/1993 | Briggs | 472/128 |

FOREIGN PATENT DOCUMENTS

38124335C1 9/1989 Germany .

*Primary Examiner*—Carl D. Friedman
*Assistant Examiner*—Beth A. Aubrey
*Attorney, Agent, or Firm*—Alan T. McCollom

[57] ABSTRACT

A waterslide play apparatus includes a stairway having a landing every two feet of vertical elevation. The stairway includes a 90 degree turn about half-way between the top and the bottom thereof. A waterslide has an upper end connected to an upper landing at the top of the stairway. The waterslide has a 180 degree bend so that the waterslide is adjacent the stairway for most of its length. Various water forming devices are positioned over the slide for expelling water onto people sliding down the slide. The devices are actuated by valves located on the stairway to permit people ascending the stairs to ride the slide to expel water onto those sliding down the slide.

25 Claims, 6 Drawing Sheets

WATERSLIDE PLAY APPARATUS

This application is a continuation-in-pan of pending U.S. Ser. No. 025,143, filed Mar. 2, 1993, which is a continuation of U.S. Ser. No. 604,496, filed Oct. 29, 1990 and issued as U.S. Pat. No. 5,194,048, which is a continuation-in-pan of U.S. Ser. No. 438,220, filed Nov. 20, 1989, which issued as U.S. Pat. No. Des. 330,579.

BACKGROUND OF THE INVENTION

1. Field of the Invention

The present invention relates generally to water park, theme park and swimming pool structures and more particularly to such structures which incorporate a waterslide.

2. Description of the Related Art

Amusement parks having water-oriented themes are becoming increasingly popular. Such parks typically include several different exhibits with which park goers, dressed in swimming suits, interact. Such exhibits may include, e.g., pools in which waves are created, wading pools for small children, pools with flotation devices upon which people can walk and waterslides. Waterslides typically include a stairway to enable slide users to walk to the uppermost portion of the slide. The waterslide most often includes plurality of water outlets at the upper portion thereof for admitting water directly onto the surface of the slide which makes for a faster ride as a result of reduced friction between a rider and the surface of the slide. Such water outlets may be interspersed at intervals along the length of the slide. The pull of gravity provides the rider with an exhilarating ride from the top of the slide to the lowermost portion thereof at which point the rider may exits the slide into a pool.

Usually only one or two people at a time are able to slide down the slide. Others are climbing the stairway to the top and/or waiting for their turn at the top while those ahead slide down one or two at a time. It would be desirable to provide a waterslide which includes activities for those waiting in line and/or climbing to the top of the waterslide.

SUMMARY OF THE INVENTION

The present invention comprises a waterslide play apparatus having a waterslide upon which a first user can slide from an upper portion of the waterslide to a lower portion. Water forming means is positioned adjacent the waterslide at a location intermediate the upper and lower portions thereof. The water forming means is operable to direct water onto a first user as he or she slides past the water forming means. Means are provided for actuating the water forming means to so direct water. A second user is supported on means adjacent the actuating means for permitting the second user to actuate the water forming means as the first user slides thereby.

it is a general object of the present invention to provide an improved waterslide play apparatus.

It is another object of the present invention to provide such an apparatus which includes devices for permitting people other than those sliding on the waterslide to engage in water play.

The foregoing and other objects, features and advantages of the invention will become more readily apparent from the following detailed description of a preferred embodiment which proceeds with reference to the drawings.

BRIEF DESCRIPTION OF THE DRAWINGS

FIG. I is a perspective view of a waterslide play apparatus constructed in accordance with the present invention.

DETAILED DESCRIPTION OF THE PREFERRED EMBODIMENT

Figure 1:
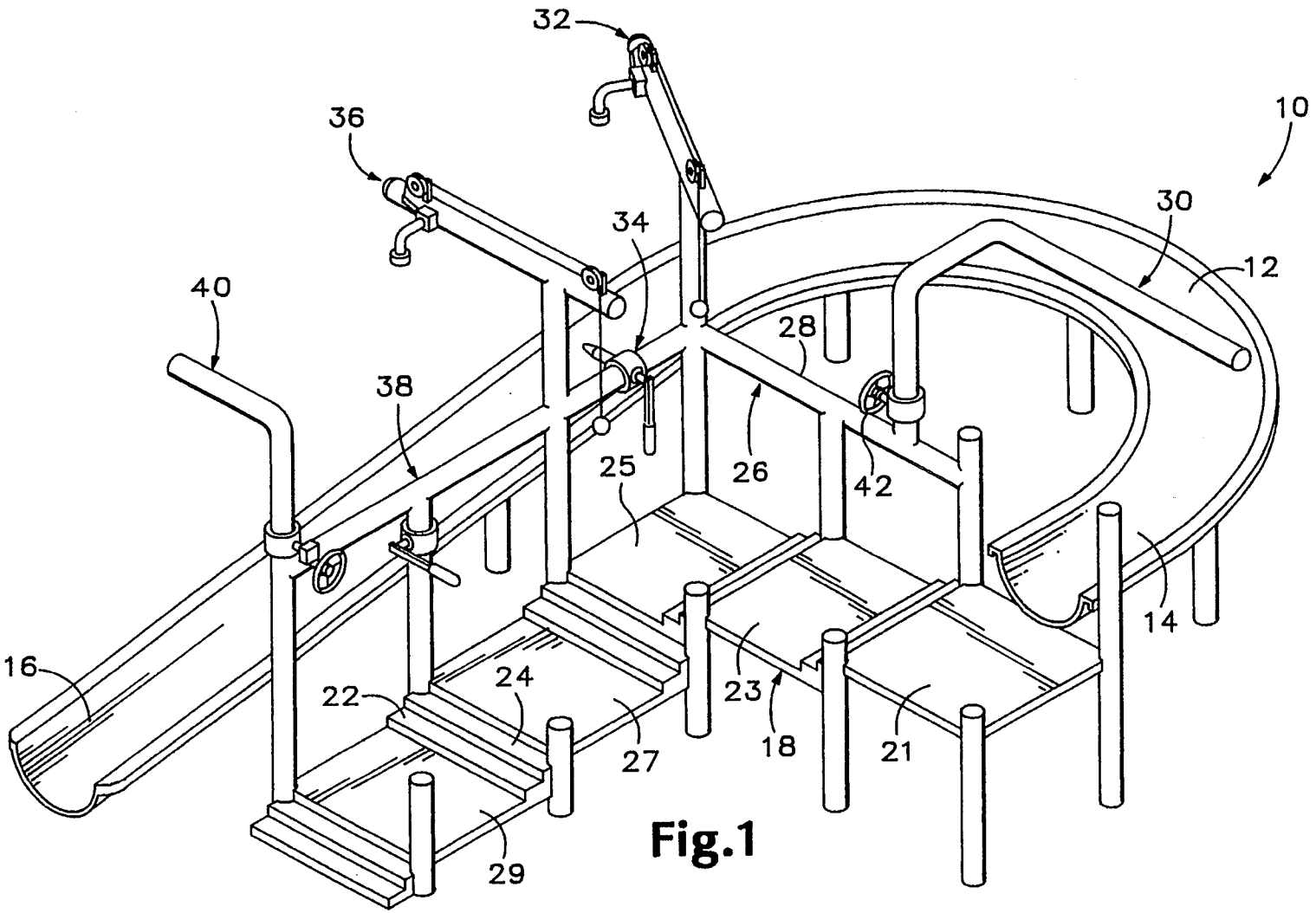
Figure 2:
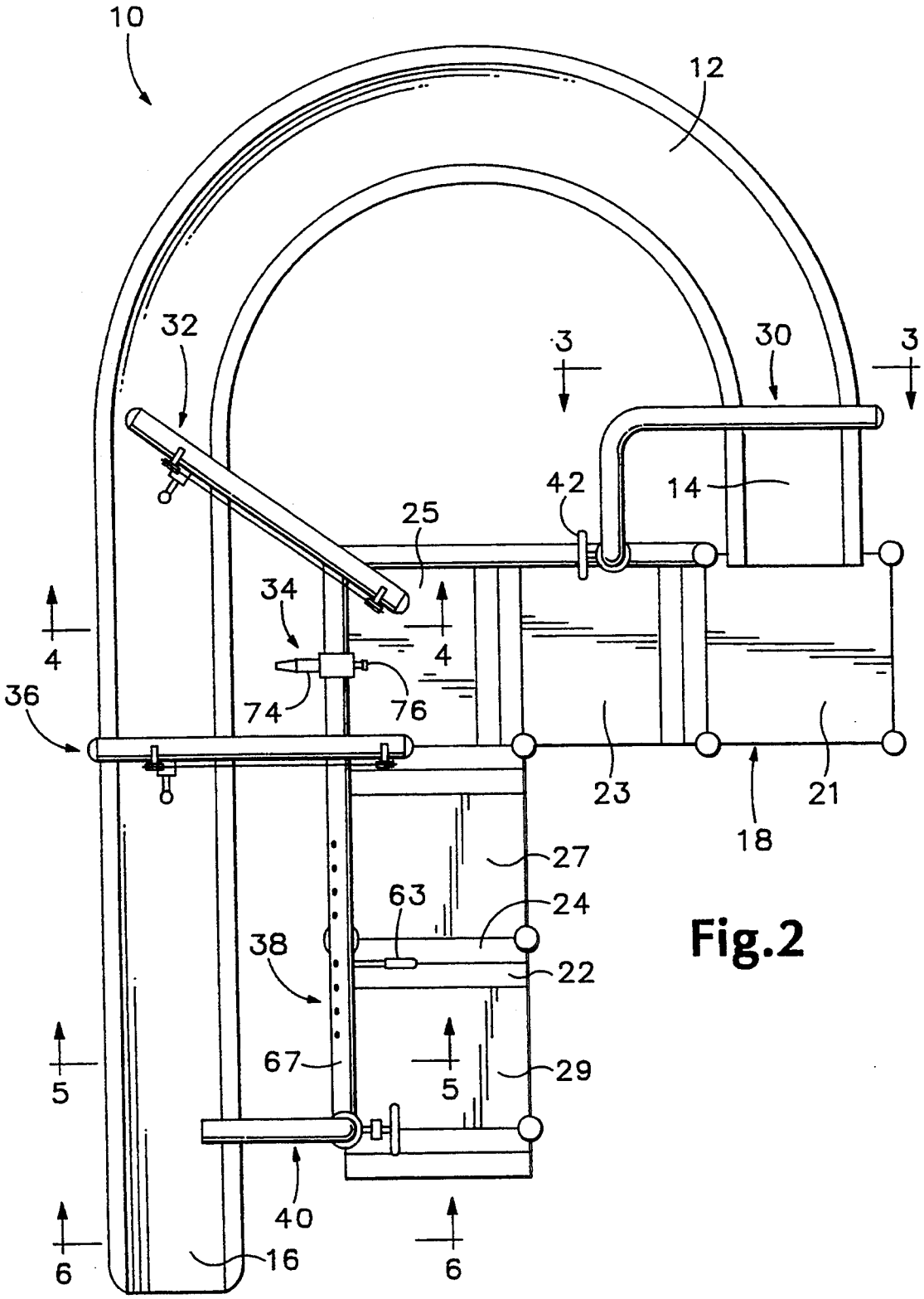
FIG. 2 is a top plan view of the waterslide play apparatus of FIG. 1.

Indicated generally at 10 in FIGS. 1 and 2 is a waterslide play structure constructed in accordance with the present invention. Included therein is a fiberglass waterslide 12 having an upper portion 14 and a lower portion 16. Also included therein is a platform 18 having a plurality of levels 21, 23, 25, 27, 29. Each platform level comprises one in a series of steps, like steps 22, 24 between levels 27, 29, which permit a person to climb platform 18 from level 29 to level 21 thereby bringing the person to a position adjacent upper portion 14 of the waterslide.

Platform 18 is supported by a frame 26 which includes a pipe 28 having a supply of water under pressure therein.

Figure 3:
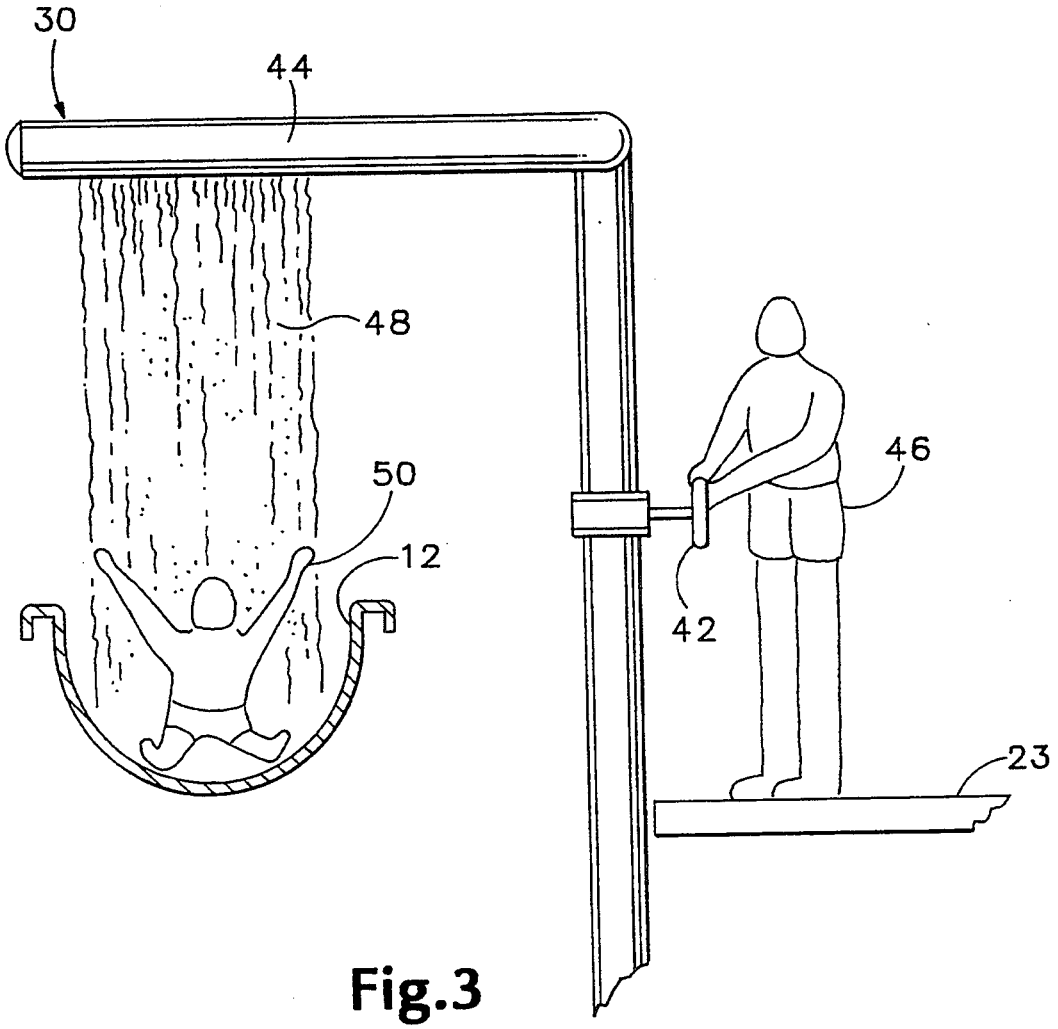
FIG. 3 is an enlarged cross-sectional view taken along line 3—3 in FIG. 2.

A plurality of water-forming means, including bar jets 30, a spray jet 32, a water gun 34, a solid-stream jet 36, arch jets 38, and pipe falls 40 are mounted on pipe 28. Each of the water-forming means has an associated valve, like valve 42 which is associated with bar jets 30. As will later be more fully explained, the associated valve permits water to flow from pipe 28 into the water-forming means which emits the water onto waterslide 12. Attention is now directed to FIG. 3 for a more detailed description of the structure of bar jets 30 and valve 42. Spray jets 30 comprise a plurality of downwardly-directed bores formed in a pipe 44 which is connected to pipe 28 (in FIG. 1) via valve 42. When a person 46, standing on level 23, opens valve 42, water is communicated from pipe 28 into pipe 44 and from there out of the bores to form a water curtain 48 through which a person 50 on waterslide 12 slides.

Figure 4:
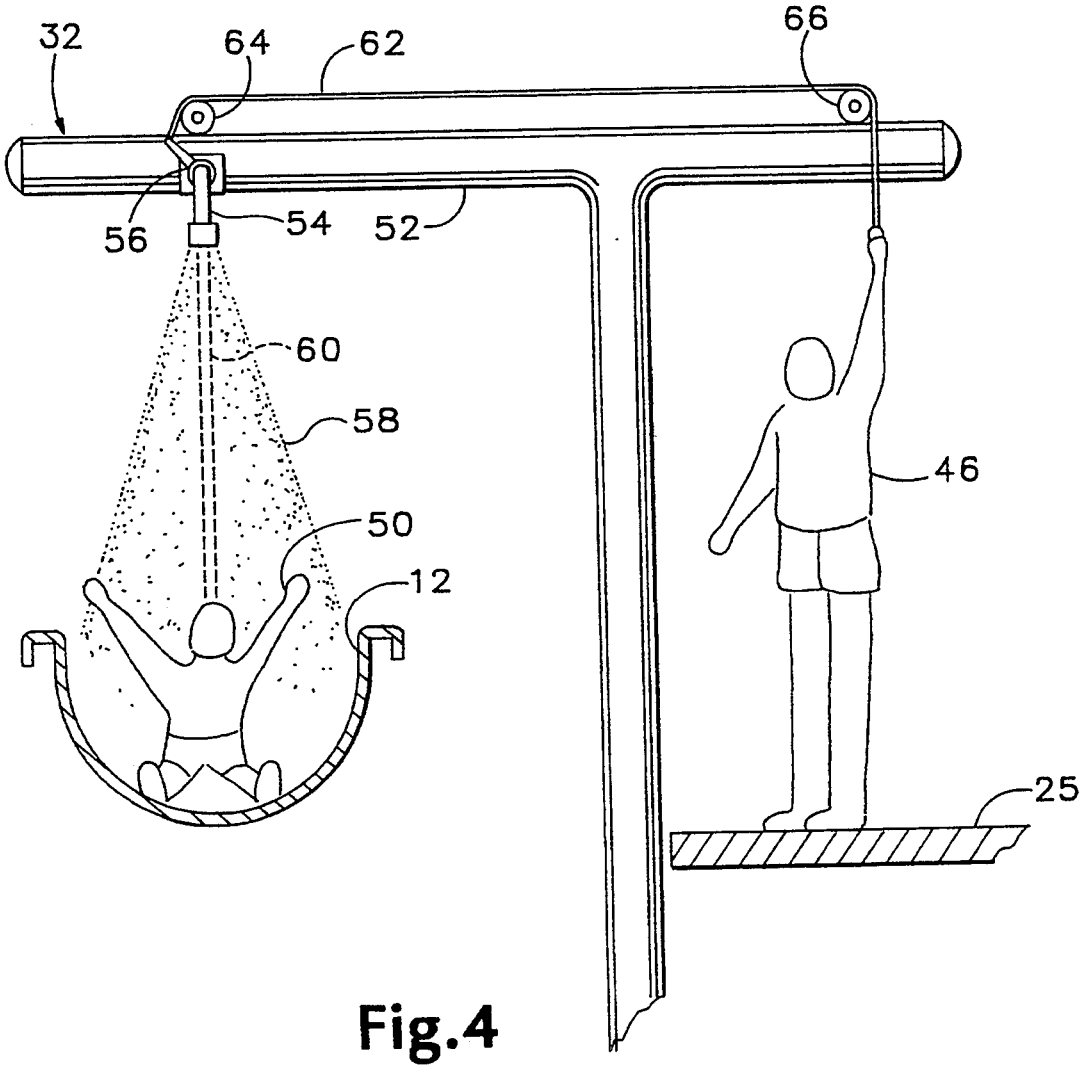
FIG. 4 is an enlarged cross-sectional view taken along line 4—4 in FIG. 2.

Turning now to FIG. 4, spray jet 32 includes a pipe 52 which is also in communication with pipe 28 (in FIG. 1). A nozzle 54 extends from a lever-actuated valve 56. When valve 56 is open, water in the form of a spray 58 is emitted from nozzle 54 onto waterslide 12. Spray 58 varies between a widely-dispersed spray which covers substantially all of waterslide 12 to a substantially solid stream, illustrated by dashed-lines 60, depending upon the position of valve 56. A line 62 is journaled over a pair of pulleys 64, 66 which are mounted on pipe 52. The person 46 on platform 25 pulls the end of line 62 to operate valve 56 so as to produce a spray which varies, dependent upon how far line 62 is pulled, between the broadly distributed spray and the solid stream illustrated in the drawing. Valve 56 is spring-biased and returns to a shut position so that no water flows from the valve when line 62 is not pulled.

Figure 5:
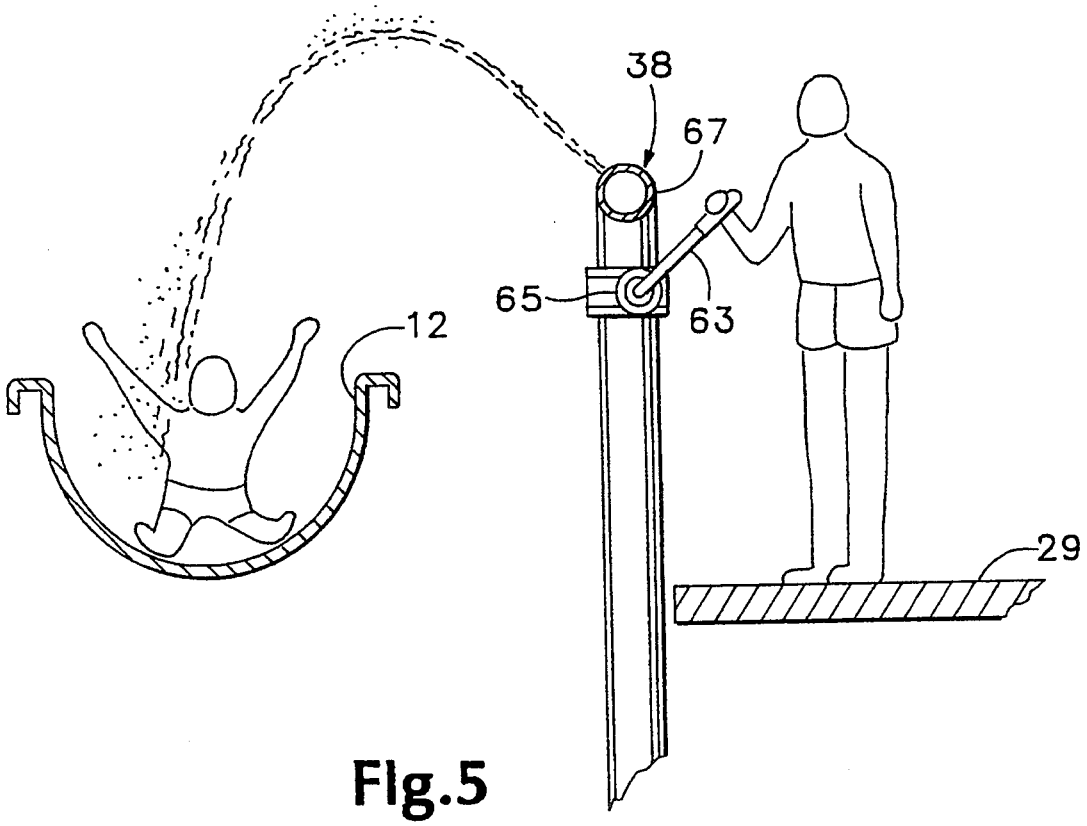
FIG. 5 is an enlarged cross-sectional view taken along line 5—5 in FIG. 2.

In FIG. 5, arch jets 38 comprise a plurality of bores, visible in FIG. 2, in pipe 28. A lever 63 is operable to open a valve 65 which permits water to flow into pipe 67 and out the bores in the form of an arch as illustrated.

Figure 6:
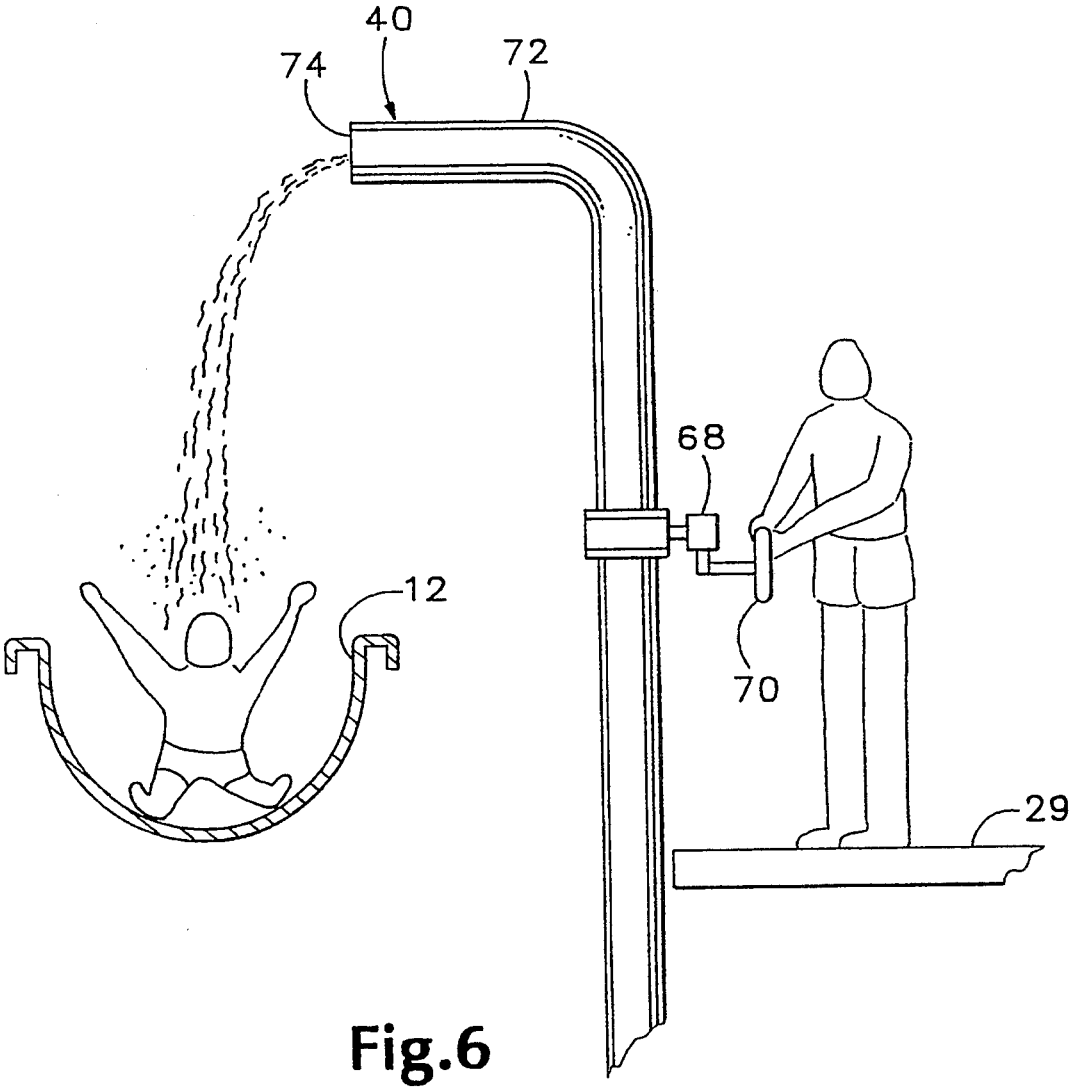
FIG. 6 is an enlarged cross-sectional view taken along line 6—6 in FIG. 2.

In FIG. 6, a valve 68, which is operated by wheel 70, permits water to flow into a pipe 72 and out an open end 74 thereof onto the waterslide as shown.

Returning again to FIG. 2, water gun 34 comprises a barrel 74 and a handle 76 which extends over level 25 of platform 18. Handle 76 includes a trigger (not visible) which actuates a valve (also not visible) that communicates water from pipe 28 into barrel 74. The barrel is aimed at the waterslide. A person squeezing the trigger can thus direct a jet of water from the barrel onto a person sliding down the waterslide.

Solid-stream jet 36 includes a pull rope actuation mechanism similar to that shown in FIG. 4. The nozzle, however, of jet 36 produces a substantially solid stream of water, like that indicated by lines 60 in FIG. 4, whenever the line operating jet 36 is pulled.

It should be appreciated that numerous other water-forming means other than those disclosed herein can be effectively utilized to emit water onto the waterslide. For example, any of those shown in U.S. Pat. No. 5,194,048 issued Mar. 16, 1993 for Participatory Water Play Apparatus, which is incorporated by reference herein, can be utilized.

in operation, people desiring to slide from upper portion 14 of the waterslide to lower portion 16 climb platform 18 using the steps formed thereon. On the way to top level 21 of the platform, people can stop and actuate a selected water-forming means as described above thereby ejecting water onto the slide and onto people who may be sliding thereon. As each person reaches the top level 21 he or she may enter upper portion 14 of the waterslide and slide down the slide in turn being sprayed by those actuating the water-forming means from the various platform levels.

It should be appreciated that the present invention can be equally well implemented on a hillside up which participants walk to reach the top of the slide. Similar water-forming means and associated actuating devices can be located along the length of the slide to permit those walking to the top of the slide to cause water to be emitted onto those sliding down the slide. In such a case, the slide may be formed from concrete rather than fiberglass. In either embodiment, the actuating device can be disposed at either the top or the bottom of the slide or at any location intermediate the top and bottom and may not necessarily be adjacent the associated water-forming means which the actuating device operates.

Having illustrated and described the principles of our invention in a preferred embodiment thereof, it should be readily apparent to those skilled in the an that the invention can be modified in arrangement and detail without departing from such principles. We claim all modifications coming within the spirit and scope of the accompanying claims.

I claim:

1. A waterslide play apparatus comprising:

a waterslide upon which a first user of said apparatus can slide from an upper portion thereof to a lower portion thereof;

a water forming means positioned adjacent said slide at a location intermediate the upper and lower portions thereof, said water forming means being operable to direct water onto said first user as said first user slides past said water forming means;

means for actuating said water forming means to so direct water therefrom; and means for supporting a second user adjacent said actuating means for permitting said second user to actuate said water forming means as a first user slides thereby.

2. The waterslide play apparatus of claim 1 wherein said apparatus further includes a plurality of said water forming means.

3. The waterslide play apparatus of claim 1 wherein said means for supporting a second user comprises a platform.

4. The waterslide play apparatus of claim 3 wherein said platform includes a plurality of levels.

5. The waterslide play apparatus of claim 4 wherein said platform levels comprise steps to enable a user of said apparatus to climb from a lower portion of said waterslide to an upper portion of said waterslide.

6. The waterslide play apparatus of claim 3 wherein said apparatus further includes a frame for supporting said platform and wherein said frame includes a pipe for providing water to said water forming means.

7. The waterslide play apparatus of claim 6 wherein said waterslide curves around said platform.

8. The waterslide play apparatus of claim 1 wherein said means for actuating said water forming means comprises a valve.

9. The waterslide play apparatus of claim 1 wherein said water forming means comprises arching jets.

10. The waterslide play apparatus of claim 1 wherein said water forming means comprises pipe falls.

11. The waterslide play apparatus of claim 1 wherein said water forming means comprises a water curtain.

12. The waterslide play apparatus of claim 1 wherein said water forming means comprises bar jets.

13. A waterslide play apparatus comprising:

a waterslide upon which a first user of said apparatus can slide from an upper portion thereof to a lower portion thereof;

means for supporting a person adjacent said waterslide intermediate said upper and lower portions;

a device for emitting water onto said waterslide, said device being positioned adjacent said waterslide; and means for switching said device between a first condition when no water is emitted and a second condition when water is emitted, said switching means being operable by a person on said supporting means.

14. The waterslide play apparatus of claim 13 wherein said device is operable to emit water upon such a first user as the first user slides by said device.

15. The waterslide play apparatus of claim 13 wherein said apparatus includes a plurality of said devices positioned adjacent said waterslide.

16. The waterslide play apparatus of claim 13 wherein said means for supporting a second user comprises a platform.

17. The waterslide play apparatus of claim 16 wherein said platform includes a plurality of levels.

18. The waterslide play apparatus of claim 17 wherein said platform levels comprise steps to enable a user of said apparatus to climb from a lower portion of said waterslide to an upper portion of said waterslide.

19. The waterslide play apparatus of claim 16 wherein said apparatus further includes a frame for supporting said platform and wherein said frame includes a pipe for providing water to said water forming means.

20. The waterslide play apparatus of claim 19 wherein said waterslide curves around said platform.

21. The waterslide play apparatus of claim 13 wherein said means for actuating said water forming means comprises a valve.

22. The waterslide play apparatus of claim 13 wherein said water forming means comprises arching jets.

23. The waterslide play apparatus of claim 13 wherein said water forming means comprises pipe falls.

24. The waterslide play apparatus of claim 13 wherein said water forming means comprises a water curtain.

25. The waterslide play apparatus of claim 13 wherein said water forming means comprises bar jets.

* * * * *